US008353609B2

(12) United States Patent
Chou et al.

(10) Patent No.: US 8,353,609 B2
(45) Date of Patent: Jan. 15, 2013

(54) LAMP MOUNTING APPARATUS AND LAMP ASSEMBLY

(75) Inventors: Chia-Shin Chou, Taipei Hsien (TW); Zhen-Xing Ye, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 379 days.

(21) Appl. No.: 12/821,887

(22) Filed: Jun. 23, 2010

(65) Prior Publication Data

US 2011/0235347 A1 Sep. 29, 2011

(30) Foreign Application Priority Data

Mar. 29, 2010 (CN) ..... 2010 1 0134141

(51) Int. Cl.

| | |
|---|---|
| ***F21V 21/28*** | (2006.01) |
| ***F21V 1/06*** | (2006.01) |
| ***F21V 17/02*** | (2006.01) |
| ***F21L 4/04*** | (2006.01) |

(52) U.S. Cl. ..... 362/450; 362/352; 362/162; 362/427; 362/413; 362/198

(58) Field of Classification Search ..... 362/177, 362/249.1, 427, 197–200, 450, 410–414, 362/162, 352; D26/60, 61
See application file for complete search history.

(56) References Cited

U.S. PATENT DOCUMENTS

| | | | | |
|---|---|---|---|---|
| 4,581,684 | A * | 4/1986 | Mazzucco | 362/98 |
| 6,377,402 | B1 * | 4/2002 | Ma et al. | 359/633 |
| D507,673 | S * | 7/2005 | Martin | D26/60 |
| 6,955,442 | B1 * | 10/2005 | Chan | 362/99 |
| 7,396,140 | B2 * | 7/2008 | Cai | 362/167 |
| 8,152,344 | B2 * | 4/2012 | Gu et al. | 362/427 |
| 2012/0140473 | A1 * | 6/2012 | Chang | 362/249.03 |

FOREIGN PATENT DOCUMENTS

| | | | |
|---|---|---|---|
| KR | 200325000 | Y1 * | 8/2003 |
| KR | 200325083 | Y1 * | 8/2003 |
| WO | WO 2010044550 | A3 * | 7/2010 |

* cited by examiner

*Primary Examiner* — Mariceli Santiago
(74) *Attorney, Agent, or Firm* — Altis Law Group, Inc.

(57) ABSTRACT

A lamp mounting apparatus includes a base, an adjusting portion, and an assembling portion. The adjusting portion includes a first end pivotably connected to the base, and a second end. The assembling portion is pivotably connected to the second end. The assembling portion is configured to have a lamp mounted thereon, and the assembling portion is capable of moving relative to the base by adjusting the adjusting portion.

18 Claims, 6 Drawing Sheets

LAMP MOUNTING APPARATUS AND LAMP ASSEMBLY

BACKGROUND

1. Technical Field

The present disclosure relates to mounting apparatuses, especially to a foldable mounting apparatus for a lamp and a lamp assembly.

2. Description of Related Art

Lamps are commonly used in everyday life. Generally, a lamp mounting apparatus for a lamp includes a base and an assembling portion for securing the lamp. The assembling portion cannot move relative to the base thus, the lamp mounting apparatus takes a great deal of physical space, which can be inconvenient when the lamp is not needed.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
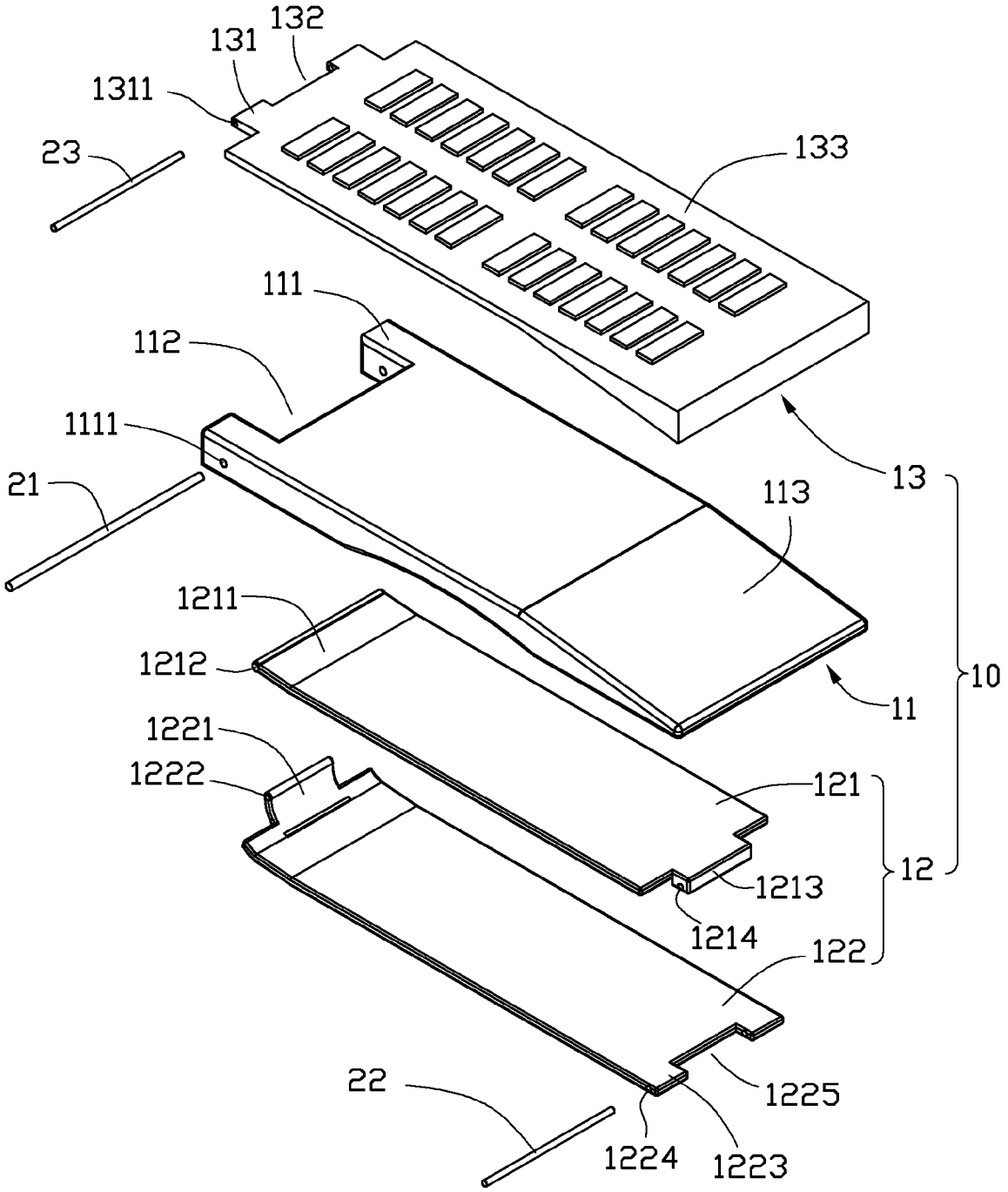
FIG. 1 is an exploded, isometric view of a lamp mounting apparatus of an embodiment.
Figure 2:
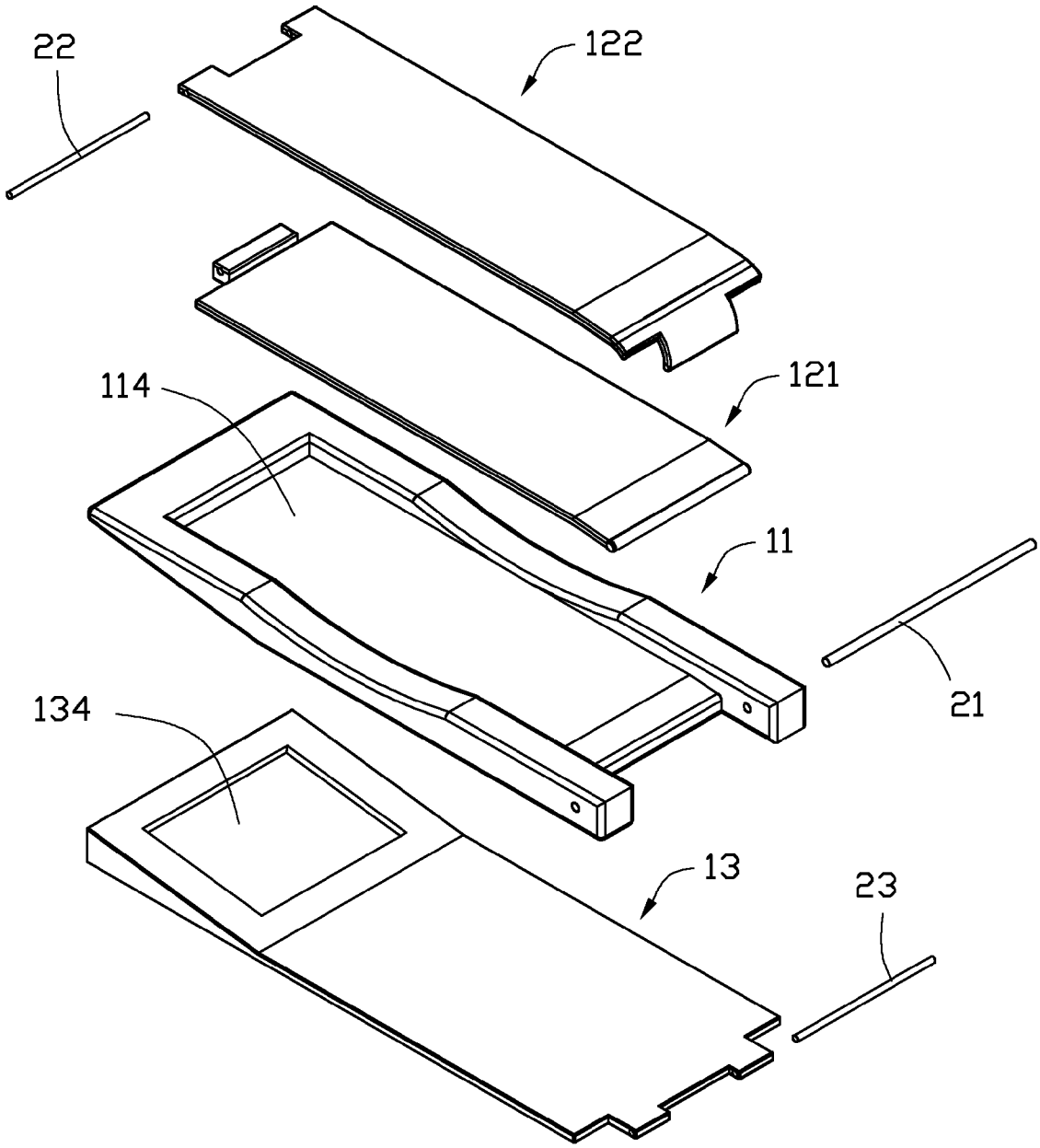
FIG. 2 is similar to FIG. 1, but viewed from another aspect.

Referring to FIGS. 1 and 2, a lamp mounting apparatus 10 is configured for accommodating a lamp (not shown). In one embodiment, the lamp is a light-emitting diode (LED).

The lamp mounting apparatus 10 includes a base 11, an adjusting portion 12, and an assembling portion 13 for assembling the lamp.

The base 11 is a flat board and includes two first pivoting portions 111 extending at opposite sides of one end of the base 11. Each first pivoting portion 111 defines a first pivoting hole 1111. A receiving space 112 is defined between the two first pivoting portions 111. An upper surface of the base 11 defines an inclining portion 113. A lower surface of the base 11 defines a hollow portion 114 configured to receive the adjusting portion 12.

The adjusting portion 12 includes a first adjusting part 121 and a second adjusting part 122, pivotably connected to the first adjusting part 121. The first adjusting part 121 includes a first rotating portion 1211 and a second rotating portion 1213 at opposite sides of the first adjusting part 121. The first rotating portion 1211 defines a first rotating hole 1212 corresponding to the first pivoting hole 1111. The second rotating portion 1213 defines a second rotating hole 1214.

The second adjusting part 122 includes a third rotating part 1221 and two second pivoting portions 1223. The third rotating part 1221 and the two second pivoting portions 1223 are disposed at opposite ends of the second adjusting part 122. The third rotating part 1221 defines a third rotating hole 1222. The two second pivoting portion 1223 each define a second pivoting hole 1224. A second receiving space 1225 is defined between the two second pivoting portions 1223.

The assembling portion 13 includes two third pivoting portions 131. Each third pivoting portion 131 defines a third pivoting hole 1311. A third receiving space 132 is defined between the two third pivoting portions 131 configured to receive the third rotating portion 1221 of the second adjusting part 122. The assembling portion 13 includes a mounting portion 133 at the free end of the assembling portion 13 corresponding to the inclining portion 113 of the base 11. The mounting portion 133 defines a mounting space 134 configured to receiving the lamp. In one embodiment, the assembling portion 13 is a solar cell panel.

Figure 3:
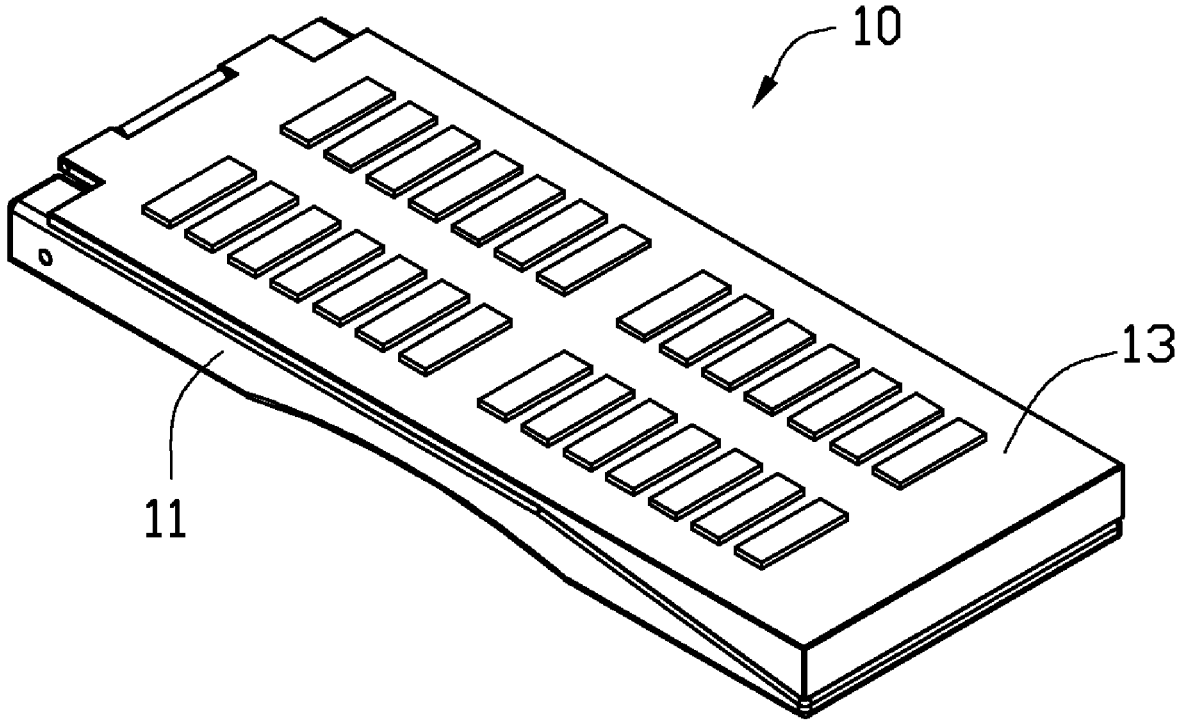
FIG. 3 is an assembled view of FIG. 1, the lamp mounting apparatus folded.

Referring FIGS. 1 to 3, in assembly, a first pivoting shaft 21 extends through the first pivoting hole 1111 of the base 11 and the first rotating hole 1212 of the first adjusting part 121, thereby pivotably securing the first adjusting part 121 to the base 11. A second pivoting shaft 22 extends through the second pivoting hole 1224 of the second adjusting part 122 and the second rotating hole 1214 of the first adjusting part 121, thereby pivotably securing the second adjusting part 122 to the first adjusting part 121. A third pivoting shaft 23 is extended through the third pivoting hole 1311 of the assembling portion 13 and the third rotating hole 1222 of the second adjusting part 122, thereby pivotably securing the assembling portion 13 to the second adjusting part 122.

When the lamp mounting apparatus 10 is in a folded state, the first adjusting part 121 and the second adjusting part 122 are received in the hollow portion 114 of the lower surface of the base 11, and the assembling portion 13 is disposed on the upper surface of the base 11. The first adjusting part 121 is disposed between the second adjusting part 122 and the base 11. The two third pivoting portions 131 are disposed between the two first pivoting portions 111. The mounting portion 133 of the assembling portion 13 contacts the inclining portion 113 of the base 11.

Figure 4:
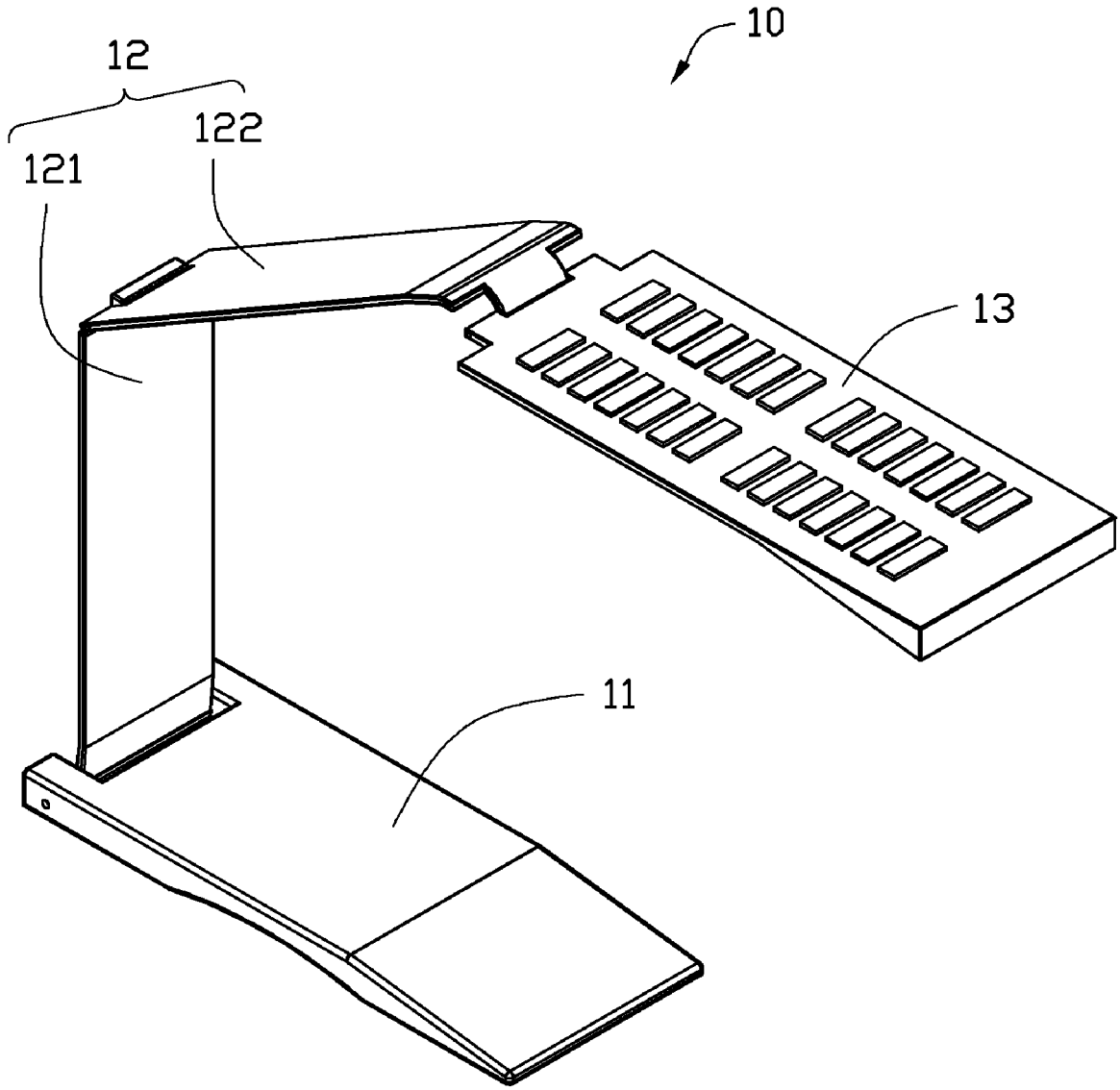
FIG. 4 is an assembled view of FIG. 1, the lamp mounting apparatus unfolded.
Figure 5:
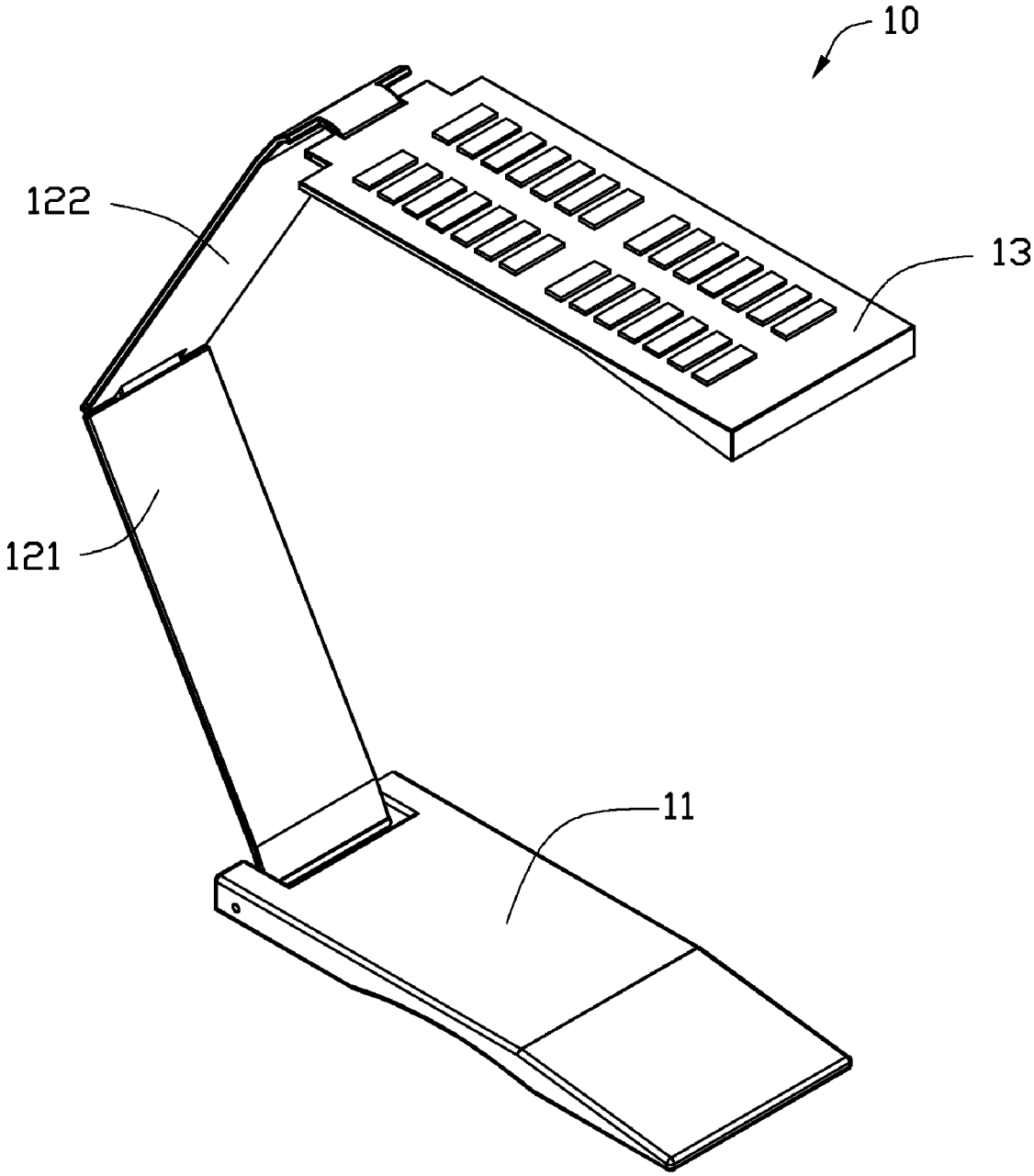
FIG. 5 is an assembled view of FIG. 1, the lamp mounting apparatus unfolded to another state.
Figure 6:
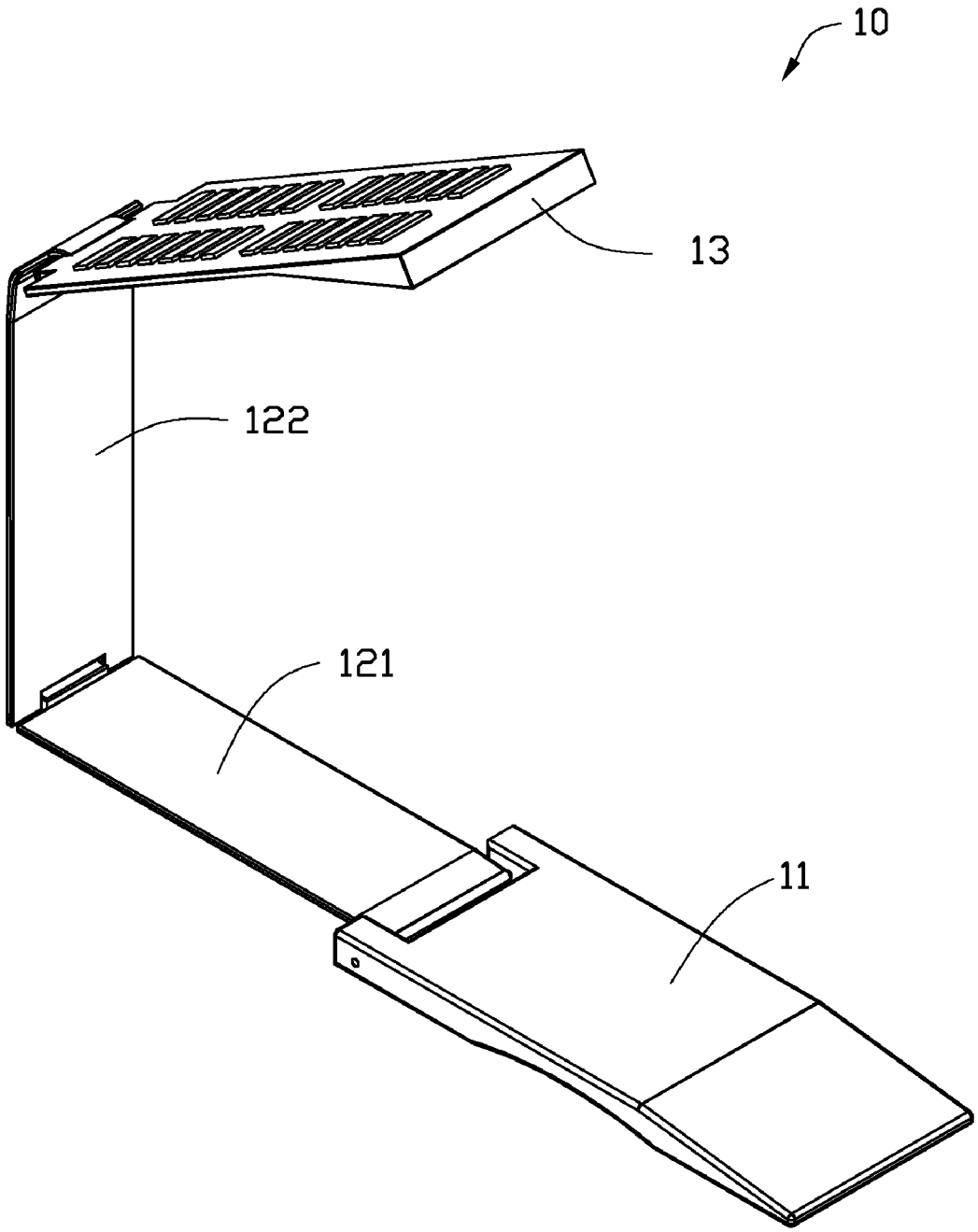
FIG. 6 is an assembled view of FIG. 1, the lamp mounting apparatus unfolded to yet another state.

Referring to FIGS. 4 to 6, the assembling portion 13 is moved relative to the base 11 in a first direction substantially parallel to the base 11 or a second direction substantially perpendicular to the first direction by adjusting the adjusting portion 12. With such an assembly, the lamp mounting apparatus 10 can be folded when not in use and thus not requiring unnecessary space to be used when not in use.

It is to be understood, however, that even though numerous characteristics and advantages of the present invention have been set forth in the foregoing description, together with details of the structure and function of the disclosure, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A lamp mounting apparatus, comprising:

a base;

an adjusting portion, the adjusting portion comprising a first end pivotably connected to the base, and a second end; and an assembling portion pivotably connected to the second end, the assembling portion configured to have a lamp mounted thereon;

wherein the assembling portion is capable of moving relative to the base in a first direction by adjusting the adjusting portion; the adjusting portion comprises a first adjusting part and a second adjusting part; and the first adjusting part pivotably connected between the base and the second adjusting part, and the second adjusting part pivotably connected between the first adjusting part and the assembling portion; and the base is disposed between the adjusting portion and the assembling portion when the lamp mounting apparatus is in a folded state.

2. The lamp mounting apparatus of claim 1, wherein the first adjusting part is disposed between the second adjusting part and the base.

3. The lamp mounting apparatus of claim 1, wherein the base comprises two first pivoting portions, and the first adjusting part comprises a first rotating portion pivotably connected between the two first pivoting portions.

4. The lamp mounting apparatus of claim 3, wherein the assembling portion comprises two second pivoting portions, and the second adjusting part comprises a second rotating portion pivotably connected between the two second pivoting portions.

5. The lamp mounting apparatus of claim 4, wherein the two second pivoting portions are disposed between the two first pivoting portions when the lamp mounting apparatus is in a folded state.

6. The lamp mounting apparatus of claim 1, wherein the first adjusting part or the second adjusting part is a panel-shaped.

7. The lamp mounting apparatus of claim 1, wherein the base comprises a hollow portion configured to receive the adjusting portion when the lamp mounting apparatus is in a folded state.

8. The lamp mounting apparatus of claim 1, wherein the assembling portion comprises a solar cell panel.

9. The lamp mounting apparatus of claim 1, wherein the base defines an inclining portion, and the assembling portion defines a mounting portion at a free end of the assembling portion configured to mount the lamp.

10. The lamp mounting apparatus of claim 9, wherein the assembling portion defines a mounting space configured to receive the lamp.

11. A lamp assembly comprising:

a lamp; and a lamp mounting apparatus, the lamp mounting apparatus comprising:

a base;

an adjusting portion, the adjusting portion comprising a first end pivotably connected to the base, and a second end; and an assembling portion pivotably connected to the second end, the assembling portion configured to have the lamp mounted thereon;

wherein the assembling portion is capable of moving relative to the base when the adjusting portion is rotated relative to the assembling portion or the base;

wherein the base defines an inclining portion, and the assembling portion defines a mounting portion at a free end of the assembling portion configured to mount the lamp.

12. The lamp assembly of claim 11, wherein the assembling portion is capable of moving relative to the base in a first direction substantially parallel to the base or a second direction substantially perpendicular to the first direction.

13. The lamp assembly of claim 11, wherein the adjusting portion comprises a first adjusting part and a second adjusting part; and the first adjusting part pivotably connected between the base and the second adjusting part, and the second adjusting part pivotably connected between the first adjusting part and the assembling portion.

14. The lamp assembly of claim 13, wherein the base is disposed between the adjusting portion and the assembling portion when the lamp mounting apparatus is in a folded state.

15. The lamp assembly of claim 13, wherein the base comprises two first pivoting portions, and the first adjusting part comprises a first rotating portion pivotably connected between the two first pivoting portions; the assembling portion comprises two second pivoting portions, and the second adjusting part comprises a second rotating portion pivotably connected between the two second pivoting portions.

16. The lamp assembly of claim 11, wherein the assembling portion defines a mounting space configured to receive the lamp.

17. A lamp mounting apparatus, comprising:

a base, the base comprises two first pivoting portions;

an assembling portion, the assembling portion configured to have a lamp mounted thereon;

an adjusting portion, the adjusting portion comprises a first adjusting part and a second adjusting part; the first adjusting part is pivotably connected between the base and the second adjusting part; the second adjusting part is pivotably connected between the first adjusting part and the assembling portion; the first adjusting part comprises a first rotating portion pivotably connected between the two first pivoting portions; and wherein the assembling portion comprises two second pivoting portions, and the second adjusting part comprises a second rotating portion pivotably connected between the two second pivoting portions.

18. The lamp mounting apparatus of claim 17, wherein the two second pivoting portions are disposed between the two first pivoting portions when the lamp mounting apparatus is in a folded state.

* * * * *